United States Patent [19]

Takami

[11] Patent Number: 4,535,737

[45] Date of Patent: Aug. 20, 1985

[54] CENTRIFUGAL SPARK-ADVANCE CONTROLLING DEVICE

[75] Inventor: Akira Takami, Hyogo, Japan

[73] Assignee: Mitsubishi Denki Kabushiki Kaisha, Tokyo, Japan

[21] Appl. No.: 579,953

[22] Filed: Feb. 14, 1984

[30] Foreign Application Priority Data

Feb. 18, 1983 [JP] Japan ..... 58-26828
Mar. 15, 1983 [JP] Japan ..... 58-44859

[51] Int. Cl.[3] ..... F02P 5/06

[52] U.S. Cl. ..... 123/420; 200/31 CA; 464/6

[58] Field of Search ..... 123/420; 200/31 CA; 464/6, 3, 5

[56] References Cited

U.S. PATENT DOCUMENTS 3,482,559 12/1969 Salomon ..... 123/420
3,923,028 12/1975 Campbell et al. ..... 123/420
3,942,492 3/1976 Iguchi ..... 123/420

FOREIGN PATENT DOCUMENTS 53-140433 12/1978 Japan ..... 123/420

*Primary Examiner*—Andrew M. Dolinar
*Attorney, Agent, or Firm*—Oblon, Fisher, Spivak, McClelland & Maier

[57] ABSTRACT

A centrifugal spark-advance controlling device has a weight being subjected to centrifugal force caused by the revolution of a driving shaft to be opened against the elastic force of a spring member to thereby advance an advancing sleeve with respect to the driving shaft. There are base plate fixed to the driving shaft, the base plate being provided with an elongated groove for guiding which serves as a guide for the weight to be moved in the direction of opening and an advancing plate fixed to the advancing sleeve, the advancing plate being provided with an elongated groove for advancing which determines a relative advance angle of the advancing sleeve with respect to the driving shaft in association with the elongated groove for guiding. The weight is placed between the base plate and the advancing sleeve and there are provided on the base plate a cylindrical projection for guiding which is inserted into the elongated groove for guiding to be engaged therewith and a cylindrical projection for advancing which is inserted into the elongated groove for advancing to be engaged therewith.

4 Claims, 7 Drawing Figures

CENTRIFUGAL SPARK-ADVANCE CONTROLLING DEVICE

The present invention relates to a centrifugal spark-advance controlling device used, for instance, for an ignition distributor of an internal combustion engine to control ignition timing. More particularly, it relates to such device capable of stabilizing its advance angle characteristic.

FIGS. 1 and 2 show a conventional centrifugal spark-advance controlling device to be installed in an ignition distributor for an internal combustion engine. In the figures, there is shown a driving shaft 1 which is firmly secured with a base plate 2. A pair of weight means are placed on the base plate 2 in a symmetrical manner with respect to the axial center of the driving shaft 1. The structure of the two weight means are identical and accordingly, description will be made as to one of them. A weight 4 is loosely fitted to a pin 3 set up on the base plate 2. An advancing pin 5 is set up on the weight 4. An advancing sleeve 7 is loosely fitted to the driving shaft 1 and the advancing sleeve 7 is firmly secured with an advancing plate 6 which has an elongated hole 6*a* engaged with the advancing pin 5. A spring 8 extends between spring hooks each being attached on the base plate 2 and the weight 4.

In the centrifugal spark-advance controlling device having the construction above-mentioned, when the driving shaft 1 is rotated, hence the device is entirely rotated, the weight 4 is subjected to the moment of opening around the pin 3 as a pivotal point, due to centrifugal force so that it opens to a position at which tensile force of the spring 8 is balanced with the moment of opening, with the result that the advancing pin 5 attached integrally with the weight 4 makes the advancing plate 6 together with the advancing sleeve 7 which is attached integrally to the advancing plate advance with respect to the driving shaft 1, through an engaging part constituted by the elongated hole 6*a* and the advancing pin 5. Thus, it is based on the principle that relative angular displacement is formed under the balanced condition between the centrifugal force produced by the function of revolution and tensile characteristic of the spring and an advance angle characteristic as indicated by (a) in FIG. 3 is obtainable.

The conventional centrifugal spark-advance controlling device is, however, so constructed that there is mainly established the principle of structure under centrifugal correspondence, in other word, angular speed correspondence for the driving shaft and construction is not made as to angular acceleration speed correspondence for the driving shaft, on account of which there appears very unstable advance angle characteristic depending on usage. Namely, there take place an abnormal jump in advance angle as shown in FIG. 3*b* and unsteadiness in advance angle as shown in FIG. 3*c* which are primary drawbacks because knocking of an engine or change in concentration of exhaust gas is caused.

It is an object of the present invention to eliminate the disadvantage of the conventional device and to provide a centrifugal spark-advance controlling device having stable advance angle characteristic by employing the principle of structure under angular acceleration speed correspondence for a driving shaft.

The foregoing and the other objects of the present invention have been attained by providing a centrifugal spark-advance controlling device in which a weight is subjected to centrifugal force caused by the revolution of a driving shaft to be opened against the elastic force of a spring member to thereby advance an advancing sleeve with respect to the driving shaft, the device being characterized by comprising a base plate fixed to the driving shaft, the base plate being provided with an elongated groove for guiding which serves as a guide for the weight to be moved in the direction of opening and an advancing plate fixed to the advancing sleeve, the advancing plate being provided with an elongated groove for advancing which determines a relative advance angle of the advancing sleeve with respect to the driving shaft in association with the elongated groove for guiding, wherein the weight is placed between the base plate and the advancing sleeve and there are provided on the base plate a cylindrical projection for guiding which is inserted into the elongated groove for guiding to be engaged therewith and a cylindrical projection for advancing which is inserted into the elongated groove for advancing to be engaged therewith.

A more complete appreciation of the present invention and many of the attendant advantages thereof will be readily obtained as the same becomes better understood by reference to the following detailed description when considered in connection with the accompanying drawings, wherein.

An embodiment of the present invention will be described with reference to drawings.

Figure 4:
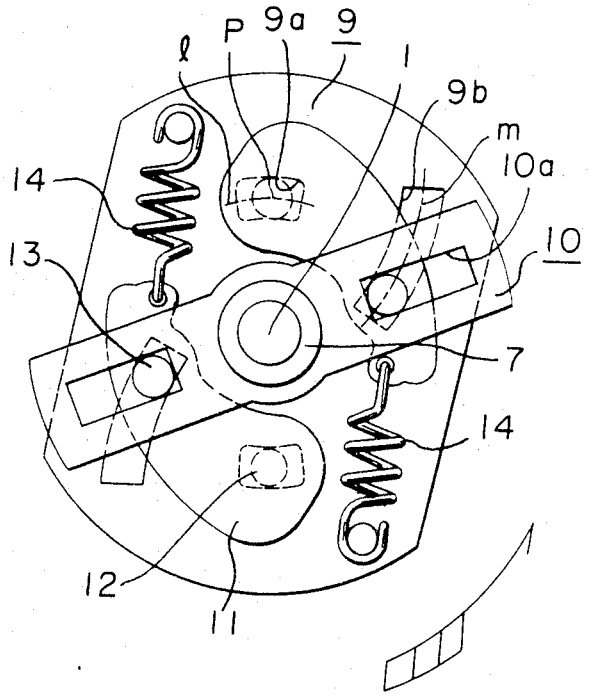
FIG. 4 is a front view of an embodiment of the centrifugal spark-advance controlling device according to the present invention.
Figure 5:
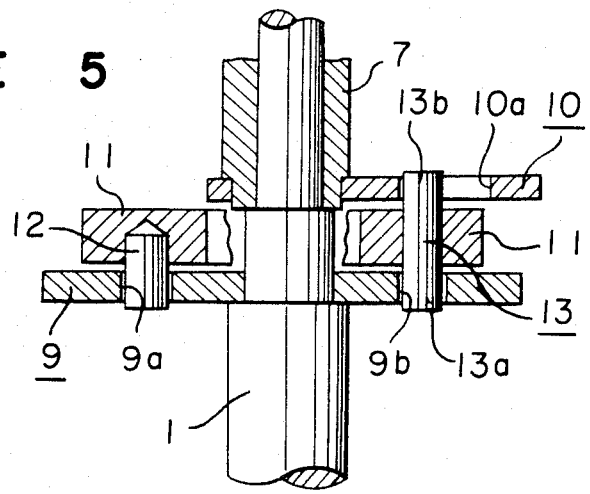
FIG. 5 is a longitudinally cross-sectional view of the device shown in FIG. 5.

FIGS. 4 and 5 show an embodiment of the device according to the present invention which is applied to an ignition distributor of an internal combustion engine.

In the figures, there is shown a base plate 9 fixed to a driving shaft 1 so as to have its surface perpendicular to the center of axis of the driving shaft 1. The base plate 9 is provided with an elongated groove for determining position 9*a* which has as the center line a part of a circle (l) drawn with a certain radius from the axial center of the driving shaft 1 and an elongated groove for guiding 9*b* which has as the center line a part of a circle (m) drawn with a certain radius from a point P which is substantially at the middle of the center line (l) of the elongated groove for determining position 9*a*. An advancing plate 10 is fixed to an advancing sleeve 7 so as to have its surface perpendicular to the axial center of the sleeve 7 and an elongated groove for advancing 10*a* is formed in the advancing plate 10, the shape of the groove being determined in such a manner of correlating to the advance angle characteristic of the device on the basis of the shape of the elongated groove for guiding 9*b*. A weight 11 is placed on the base plate 9 and is provided at its one end with a position-determining pin 12 as a cylindrical projection which is fixed to and extends downwardly from the lower surface of the weight 11. The position-determining pin 12 is engaged with the elongated groove for determining position 9*a*. At a position apart from the pin 12 in the weight 11, a rod 13 is fixed so as to extend from both the upper and lower surfaces of the weight 11, the rod being constituted by a cylindrical projection for guiding 13*a* extending downwardly to engaged with the elongated groove for guiding 9*b* and a cylindrical projection for advancing 13*b* extending upwardly to engage with the elongated groove for advancing 10*a*. An elastic member 14 which can be a spring extends between spring hooks each provided on the base plate 9 and the weight 11.

Figure 1:
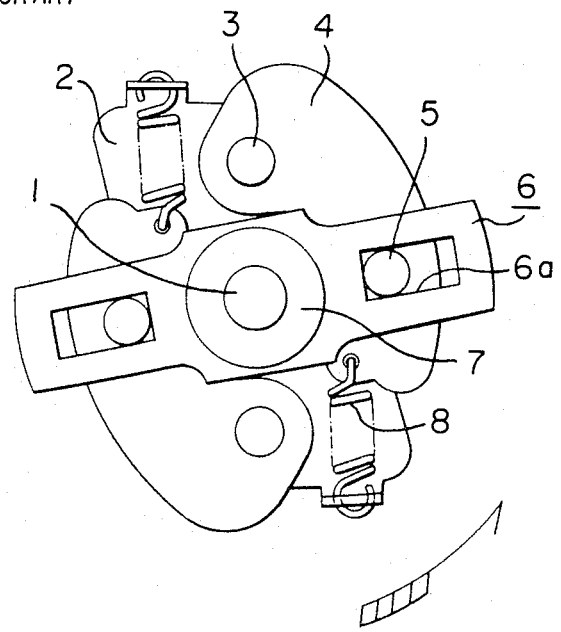
FIGURE 1 PRIOR ART
FIG. 1 is a front view showing schematically a conventional centrifugal spark-advance controlling device.
Figure 2:
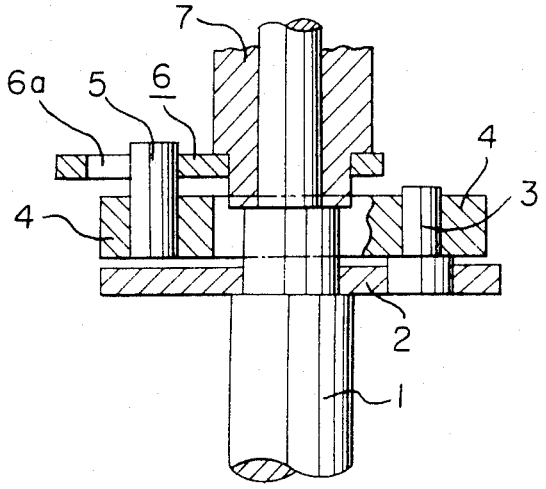
FIGURE 2 PRIOR ART
FIG. 2 is a longitudinally cross-sectional view of the device shown in FIG. 1.

The embodiment having the construction as abovementioned has an unique feature in a rotational force transmitting mechanism for transmitting force from the driving shaft 1 to the weight 11. Namely, in the conventional device, as apparent from the description with reference to FIG. 1, the rotational force of the driving shaft 1 is given to the weight 4 by the pin 3 as a pivotal shaft around which the weight 4 is opened by centrifugal force. On the other hand, as understood from the description with reference to FIG. 4, the embodiment of the present invention is so constructed that the rotational force of the driving shaft 1 is given to the weight 11 by means of the cylindrical projection for guiding 13*a* and a shaft for making the weight opened due to centrifugal force is the position-determining pin 12.

Figure 3:
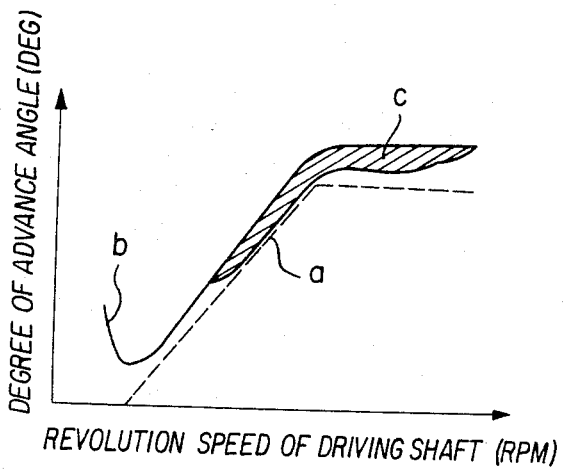
FIG. 3 is a diagram showing advance angle charactgeristic of the conventional device.

By the way, even in the device of the present invention, there is obtainable advance angle characteristic as shown in FIG. 3*a* when the device operates based on the principle of structure under angular speed correspondence for the driving shaft 1 as in the conventional device, namely, it operates due to only centrifugal force given to the weight. The reason is that the pin 3 and the advancing pin 5 in FIG. 1 respectively correspond to the position-determining pin 12 and the rod 13 in FIG. 4 and they are the same in structure.

In the following, description will be made in a qualitative manner as to the principle of structure of the device when angular acceleration speed acts on the driving shaft.

In general, abnormality in ignition timing caused by angular acceleration speed in an ignition distributor of an internal combustion engine mainly takes place by the affect of inertia torque produced dependent on the moment of inertia of structural elements connected to the later stage of the weight 11 in a power transmission course inintiated from the driving shaft 1, the elements being the advancing plate 10, the advancing sleeve 7, a distributing rotor though not shown and so forth.

Figure 6:
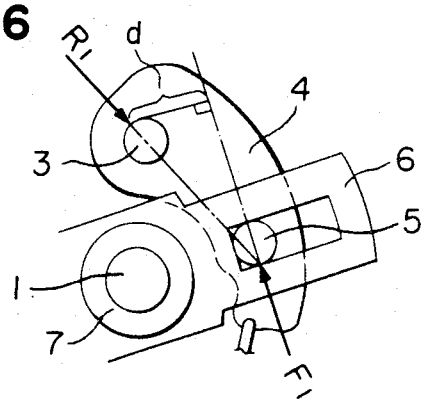
FIGURE 6 PRIOR ART
FIG. 6 is a front view of an important part of the device shown in FIG. 1.
Figure 7:
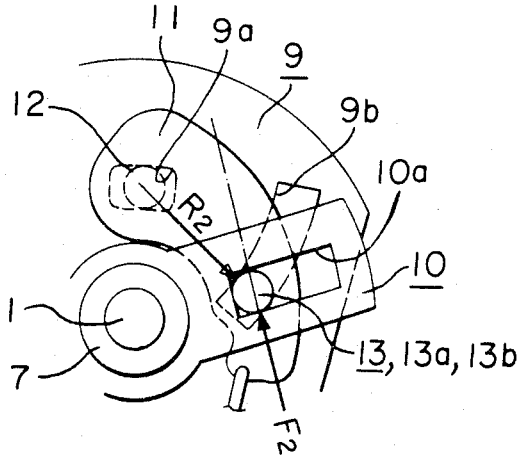
FIG. 7 is a front view of an important part of the device shown in FIG. 4.

FIGS. 6 and 7 are respectively diagrams showing relationship between forces, produced due to centrifugal force, given to elements constituting an advance controlling device when the driving shaft 1 is subjected to a negative angular acceleration speed.

In the conventional device shown in FIG. 6, a force $F_1$ produced by inertia of structural elements connected to the later stage of the weight 4 acts on the advancing pin 5 and a reactive force $R_1$ acts on the pin 3 from the side of the driving shaft 1. The weight 4 is subjected to the torque of opening in proportional to the product of the force $F_1$ and the length of a leg d being the perpendicular which extends from the point of action of the reactive force imparted to the pin 3 as a pivotal shaft for opening, to the line of action of the force $F_1$. The reactive force $R_1$ has almost no component of action with respect to opening of the weight 4 and has no function to inhibit the opening of the weight 4. In the embodiment of the present invention shown in FIG. 7, the cylindrical projection for advancing 13*b* is subjected to a force $F_2$ produced by inertia of structural elements connected to the later stage of the weight 11 and the cylindrical projection for guiding 13*a* is subjected to the reactive force $R_2$ from the side of the driving shaft 1. Namely, a wedge is formed by the elongated groove for advancing 10*a* and the elongated groove for guiding 9*b* to clamp the rod 13 and the torque for opening the weight 11 produced by the force $F_2$ is far small in comparison with that of the conventional device because of different point of action of the reactive force $R_2$. Further, the reactive force produces an unique opening-inhibition torque, which has not been attained by the conventional device, by a frictional force produced between the elongated groove for guiding 9*b* and the cylindrical projection for guiding 13*a*. The unique opening-inhibition torque has a remarkable feature that it is caused by the frictional force produced solely during angular acceleration speed correspondece and accordingly, there takes place no increase of hysteresis which decreases the value of advance angle characteristic determined dependent on angular speed. The unique opening-inhibition torque has another feature that it functions greatly rather than in a low revolution speed region, that is, in a region that the degree of opening of the weight 11 becomes small, which causes problem of abnormal advance angle due to angular acceleration speed in the conventional device.

In the embodiment shown in FIGS. 4 and 5, though description has been made as to case that the center P of a circular arc (m) being the center line of the elongated groove for guiding 9*b* is on the circular arc (l) being the center line of the elongated groove for determining position 9*a*, it is possible that the center for the point P is apart from the circular arc (m) as the center line inside or outside. Rather, by making the device constructed positively, it may be necessary that the opening-inhibition torque caused by the reactive force $R_2$ is employed in design in connection with the degree of the opening of the weight 11.

In the embodiment of the present invention, there has been described that the cylindrical projection for guiding 13*a* and the cylindrical projection for advancing 13*b* are made in one piece to be held in the weight 11. It is, however, possible to obtain effect at which the present invention aims even though these projections are formed in separate bodies or placed in a different position.

As described above, since the device according to present invention is so constructed that the point of action of force is changed with respect to a weight as an important structural element placed in the way of a power transmission course to produce frictional force being unique in the principle of structure and exhibiting an excellent property, a centrifugal spark-advance controlling device eliminating unstable advance angle characteristic for angular acceleration speed of a driving shaft can be obtained.

I claim:

1. A centrifugal spark-advance controlling device in which a weight is subjected to centrifugal force caused by the revolution of a driving shaft to be opened against the elastic force of a spring member to thereby advance an advancing sleeve with respect to said driving shaft, comprising:

a base plate fixed to said driving shaft, said base plate being provided with an elongated groove for guiding which serves as a guide for said weight to be moved in the direction of opening and an advancing plate fixed to said advancing sleeve, a position-determining pin extending downwardly from said weight to be engaged with an elongated groove for determining position in an arcuate form formed in said base plate and said elongated groove for guiding is of an arcuate form, said advancing plate being provided with an elongated groove for advancing which determines a relative advance angle of said advancing sleeve with respect to said driving shaft in association with said elongated groove for guiding, wherein said weight is placed between said base plate and said advancing plate and there are provided on said base plate a cylindrical projection for guiding which is inserted into said elongated groove for guiding to be engaged therewith and a cylindrical projection for advancing which is inserted into said elongated groove for advancing to be engaged therewith.

2. A centrifugal spark-advance controlling device according to claim 1 wherein the axial center of said driving shaft is the radius center of said elongated groove for determining position in an arcuate form and the the radius center of said elongated groove for guiding in an arcuate form is at the center of the center line of said elongated groove for determing position.

3. A centrifugal spark-advance controlling device according to claim 1 wherein the axial center of said driving shaft is the radius center of said elongated groove for determining position in an arcuate form and the the radius center of said elongated groove for guiding in an arcuate form is out of the center of the center line of said elongated groove for determining position.

4. A centrifugal spark-advance controlling device according to claim 1, wherein said cylindrical projection for guiding and said cylindrical projection for advancing are formed in one piece to constitute a rod which is fixed to said weight to extend both upper and lower surfaces of said weight.

* * * * *